US007395738B1

(12) United States Patent
Nelson

(10) Patent No.: US 7,395,738 B1
(45) Date of Patent: Jul. 8, 2008

(54) DOUBLE ACTION SOCKET WRENCH

(75) Inventor: Thomas Paul Nelson, Kenosha, WI (US)

(73) Assignee: Thomas P Nelson, Kenosha, WI (US)

( * ) Notice: Subject to any disclaimer, the term of this patent is extended or adjusted under 35 U.S.C. 154(b) by 0 days.

(21) Appl. No.: 11/831,455

(22) Filed: Jul. 31, 2007

Related U.S. Application Data

(60) Provisional application No. 60/944,119, filed on Jun. 15, 2007.

(51) Int. Cl.
*B25B 17/00* (2006.01)
*B25B 13/46* (2006.01)

(52) U.S. Cl. ..... 81/57.29; 81/58.1

(58) Field of Classification Search ..... 81/57.29, 81/58.1, 62, 63; 74/126, 142, 167; 192/43.1
See application file for complete search history.

(56) References Cited

U.S. PATENT DOCUMENTS 2,603,976 A * 7/1952 Hilton ..... 74/142
3,952,617 A * 4/1976 Gegg ..... 81/62
4,406,184 A * 9/1983 Cockman, Jr. ..... 81/57.29
4,474,089 A * 10/1984 Scott ..... 81/57.29
4,545,267 A * 10/1985 Shumway ..... 81/57.29
4,907,476 A * 3/1990 Singleton ..... 81/57.29
5,201,255 A * 4/1993 Gegg ..... 81/57.29
7,069,818 B1 * 7/2006 Huang ..... 81/57.29

* cited by examiner

*Primary Examiner*—David B Thomas

(57) ABSTRACT

This invention relates to bi-directional ratcheting socket wrenches having two modes of operation that can be used independently or simultaneously and having only one ratchet mechanism. This invention can rotate a work piece by being rotated around the socket axis as is common to socket wrenches, the handle can be rotated around its axis or the two motions can be combined as one fluid motion. This can be accomplished in either direction of rotation while permitting the ability to reposition the wrench and/or the handle. Again, this is achieved using a single ratchet mechanism. This invention also provides a means to lock the handle in position relative to the wrench itself, a means to sufficiently retain the handle without impeding handle rotation, a means to mount the handle on a bearing and a means to provide alternative embodiments of the wrench to further increase its usefulness in confined areas.

6 Claims, 7 Drawing Sheets

DOUBLE ACTION SOCKET WRENCH

FIELD OF INVENTION

The present invention relates to a socket wrench and its preferred embodiments having two modes of operation that can be employed independently or simultaneously, having a lockable handle and having a single ratchet mechanism.

BACKGROUND OF THE INVENTION

Considerable effort has been spent trying to perfect a socket wrench having two modes of operation that can be used independently or simultaneously. Some factors that have greatly limited the success of these efforts are ratchet mechanism location, the type of ratchet mechanism used and handle mounting and retention.

The prior art of Singleton (U.S. Pat. No. 4,907,476) is an example of ratchet mechanism location effecting handle and ratchet mechanism operation. In that prior art, the ratchet mechanism is in the head, allowing the wrench to be rotated and repositioned as is a common socket wrench, but the t-handle can only be rotated in one direction and not repositioned. This is due to the fact that the ratchet mechanism in the head only allows rotation in one direction relative to the head. When the t-handle is turned, the ratchet pawls disengage to allow rotation relative to the head but when attempting to reposition the t-handle in the other direction, the ratchet pawls now engage, blocking rotation. This also means that when using the socket wrench in the common manner, anytime the socket rotates relative to the head (i.e. repositioning), it causes the t-handle to rotate again. Several prior art attempts have been made to improve this situation by adding a second ratchet mechanism, including Gegg (U.S. Pat. Nos. 3,952,617 and 5,201,255) and Scott (U.S. Pat. No. 4,474,089). This resulted in wrenches of great complexity and a high number of custom parts that can have a detrimental impact on assembly and production. Further, the prior art of Cockman, Jr. (U.S. Pat. No. 4,406,184) teaches that by locating a single ratchet mechanism in the handle, completely disconnected from the head, two modes of operation can be achieved simultaneously, making a second ratchet mechanism unnecessary.

While Cockman, Jr. (U.S. Pat. No. 4,406,184) taught ratchet mechanism location, its efforts to provide sufficient means to retain the handle had questionable results at best. A handle that is required to move along the longitudinal axis of the socket wrench to lock, it seems, could just as easily become unlocked when the forces applied to the handle are not completely perpendicular to the handle. This situation may cause the handle to suddenly come unlocked, the handle retaining screw to impact the side of its slot, subjecting it to considerable side loads, and more likely than not causing eventual failure of the handle retaining screw.

It is apparent that some have tried to overcome these obstacles by what amounts to interconnecting a right-angle driver extension to a type of ratcheting screwdriver. Again, handle retention becomes a significant problem. The methods employed to retain a screwdriver handle are designed to deal with rather small rotational forces and quickly fail when placed under heavy side loading. It would appear that some have tried to downplay the issue. Prior art Huang (U.S. Pat. No. 7,069,818), Gegg (U.S. Pat. No. 5,201,255), Scott (U.S. Pat. No. 4,474,089) and Cockman, Jr. (U.S. Pat. No. 4,406,184), to name a few, all lack, in this writers opinion, a quickly discernable, proven method of handle retention that is capable of withstanding the loads encountered when using a socket wrench in the described manners.

Another problem with the ratcheting screwdriver solution is the selection of ratchet mechanisms. Typically, a socket wrench contains a ratchet mechanism able to endure greater loads than any found in a ratcheting screwdriver. The ratchet mechanisms typically found in socket wrenches also have a greater number of teeth meaning that the socket wrench can be rotated and repositioned in as little as six to nine degrees of movement. A typical ratcheting screwdriver may require eighteen degrees of movement to be repositioned. This situation becomes apparent in prior art Huang (U.S. Pat. No. 7,069,818), forcing the use of gear reduction in the head to compensate for this predicament.

Another problem to consider is deflection and/or bending. When side loading the handle, if the load is conveyed directly to the drive shaft or some type of coupling device, there is a great possibility that the shaft or coupler will become jammed, distorted or bent, leaving the tool inoperable. Obviously, a socket wrench of the type described, needs some form of structure to withstand the loads encountered in everyday use.

Prior art Cockman, Jr. (U.S. Pat. No. 4,406,184) also taught the use of a means to lock the handle in position relative to the wrench itself. Because the handle and the ring gear for the ratchet mechanism rotate as one, when the tool is rotated around the axis of the socket to input torque in common fashion, the ratchet mechanism pawl engages the ring gear causing the handle to rotate in the opposite direction of the tool itself. Under relatively light loads this tendency can be opposed manually simply by the user holding the handle in position but under heavier loads there is a need to mechanically hold the handle in position. Again, a handle that is able to move along the axis of the wrench, it seems, could easily become disengaged from the desired setting, having a severe impact on tool function.

SUMMARY OF THE INVENTION

Thus, the invention is a ratcheting socket driver capable of two modes of socket rotation that can be used independently of one another or simultaneously. The first mode of socket rotation is to rotate the entire tool around the working axis of the socket, as is common to most socket wrenches, and then to reposition the tool back to a certain point, repeating the process as necessary to progress the work piece. The second mode of socket rotation is to rotate the handle of the tool around the longitudinal axis of the tool, similar to using a screwdriver, and then to reposition the handle back to a certain point, again repeating this process as necessary. Either of these two modes of operation can be used one at a time or combined in any ratio to progress the work piece.

The invention also includes a movable handle-locking device.

The invention also includes a hub assembly for the purpose of allowing the handle to be rotatably mounted to the body of the tool.

In another preferred embodiment, the hub assembly would include a bearing for the purpose of reducing friction and drag.

In another preferred embodiment, the invention also includes a bevel gear set with a ratio of greater than 1:1. This means the handle to socket ratio could be increased to gain a mechanical advantage.

In another preferred embodiment, the invention includes an articulated head and drive shaft. This means the head could be rotated somewhat off axis along a plane.

In another preferred embodiment, the invention includes a head having its axis offset from that of the handle.

DETAILED DESCRIPTION

Figure 1:
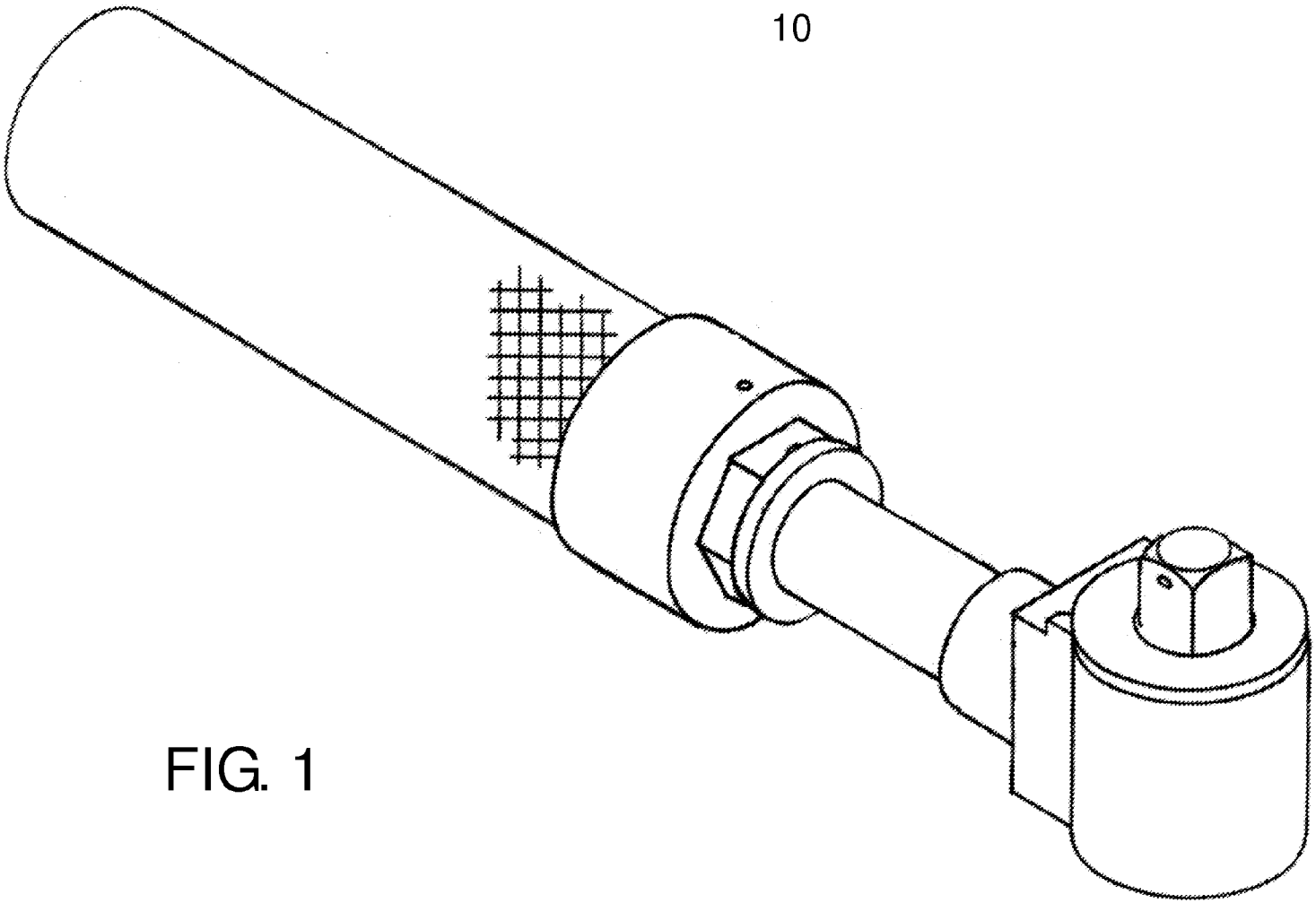
FIG. 1 is a full isometric view of socket wrench 10 with handle 25 locked.

Drawings and descriptions combine to refer to socket wrench 10 (FIG. 1) that is the invention. Anterior refers to end nearest the right-hand margin as drawn. Posterior refers to the distal end.

Figure 2:
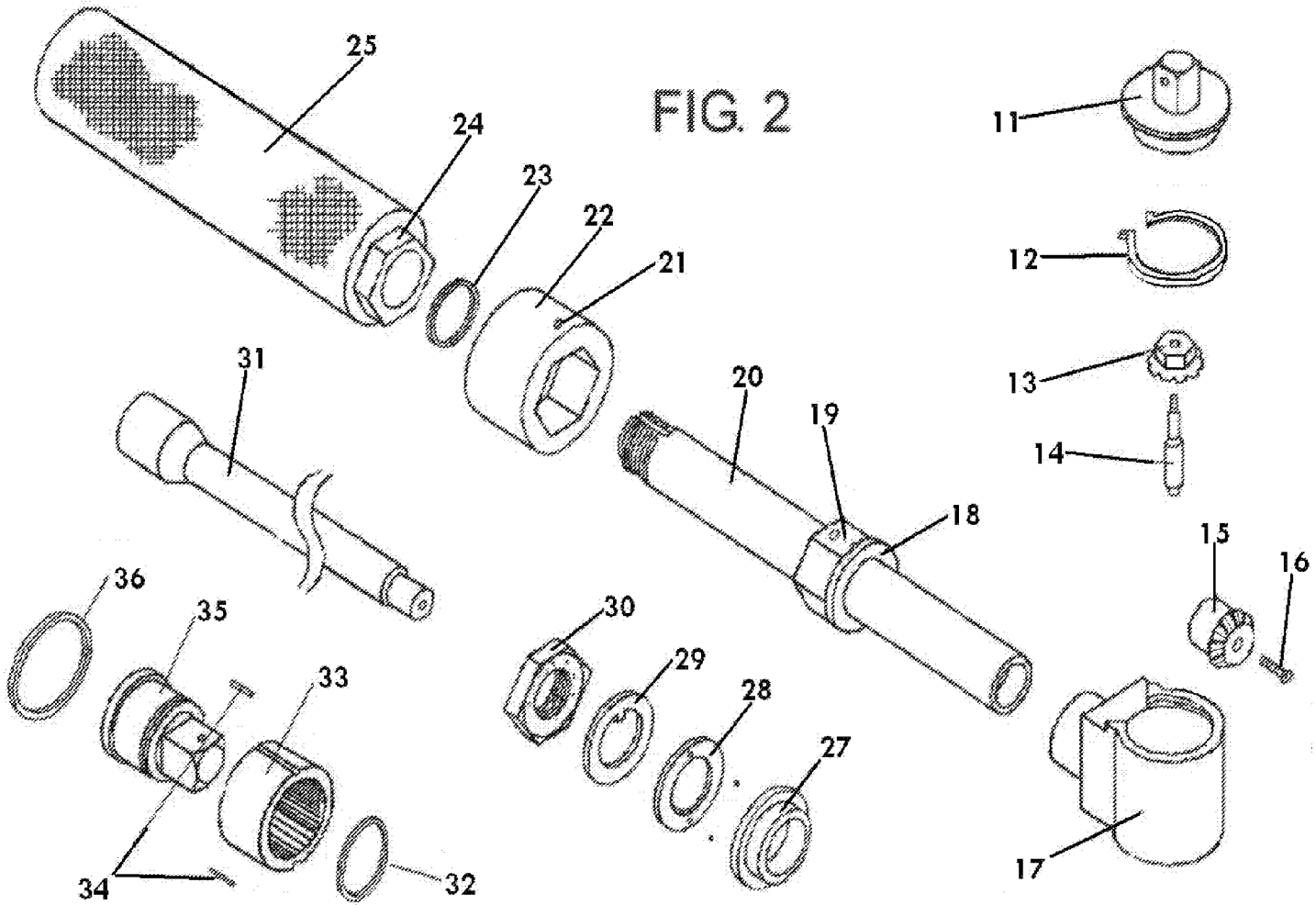
FIG. 2 is an exploded isometric view of socket wrench 10 and its parts.
Figure 3:
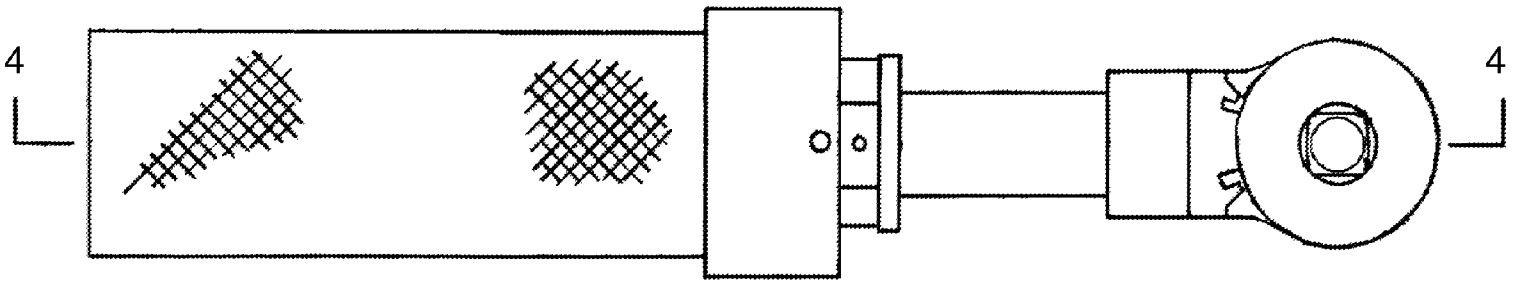
FIG. 3 is a top view of socket wrench 10 with handle 25 locked.
Figure 4:
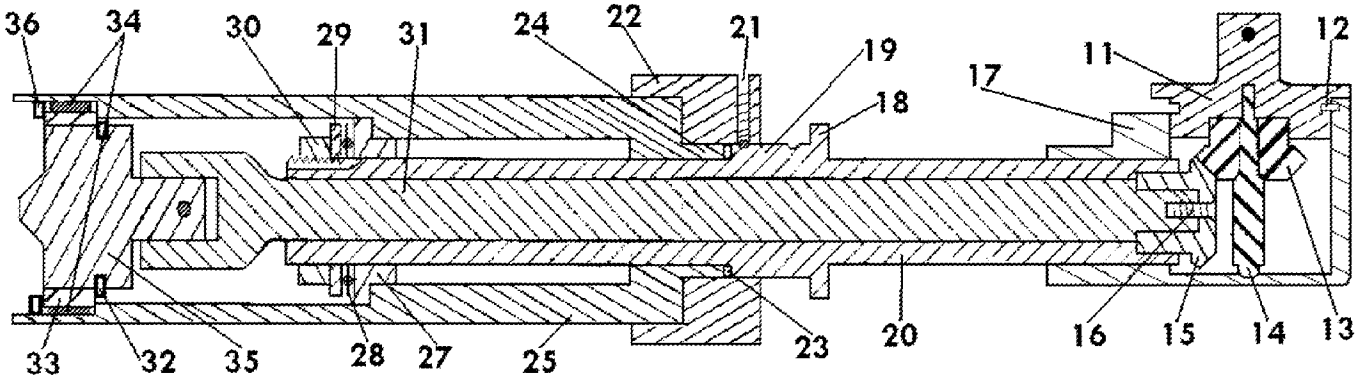
FIG. 4 is a sectional view of socket wrench 10 per section lines 4-4 of FIG. 3.
Figure 5:
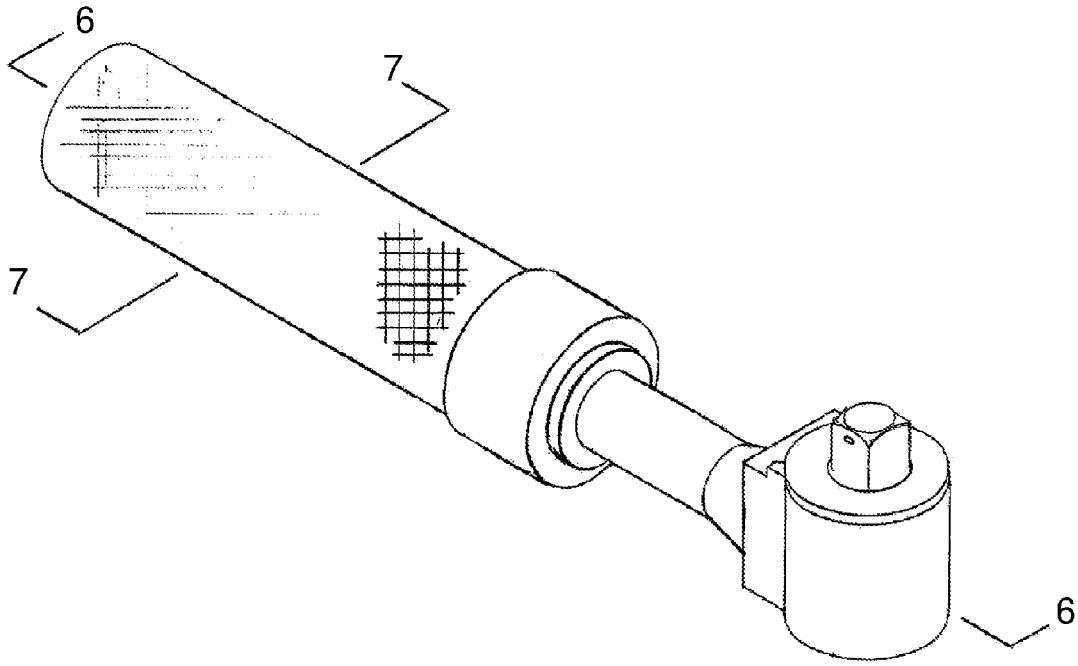
FIG. 5 is a full isometric view of socket wrench 10 with handle 25 unlocked and integral head 17 and body 20.
Figure 6:
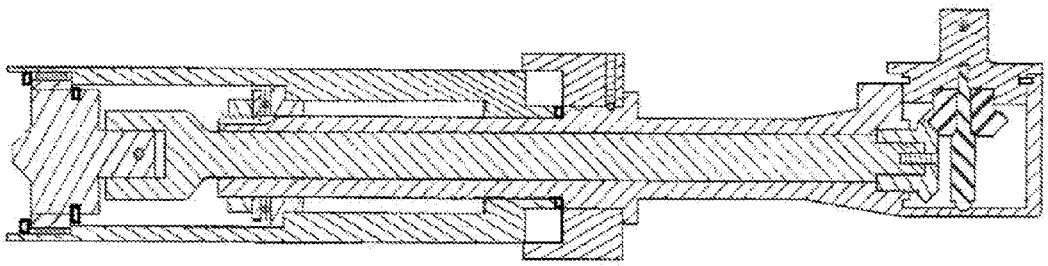
FIG. 6 is a sectional view of socket wrench 10 per section lines 6-6 of FIG. 5.

Three of the main parts of socket wrench 10 are body 20 (FIGS. 2 and 4), head 17 and handle 25. Head 17 is either permanently mounted in a fixed position to the anterior end of body 20 (FIGS. 1,2,3 and 4) or is an integral part of body 20 (FIGS. 5 and 6). Handle 25 is rotatably mounted to the posterior end of body 20.

Body 20, is an elongated tube, having a hollow, circular interior section running through its length, open at both ends. Posterior end of body 20 has as some of its exterior portions, a threaded segment corresponding to lock nut 30 and a grooved keyway corresponding to inside tab washer 29. The anterior end has as some of its portions, an enlarged circular opening that forms a cavity corresponding to the hub of second miter gear 15. Body 20 also has as one of its integral parts lock collar chassis 19. As drawn, lock collar chassis 19 is hexagon-shaped but could be any shape that prevents lock collar 22 from rotating around the longitudinal axis of body 20. Lock collar chassis 19 is positioned near the mid-point along the length of body 20. The narrowest width of lock collar chassis 19 is greater than the outside diameter of the posterior portions of body 20. Lock collar chassis 19 has two semi-circular detents on one of its sides in correspondence with ball detent assembly 21. Body 20 also has as one of its integral parts lock collar stop 18 conjoined to the anterior end of lock collar chassis 19. Lock collar stop 18 has a diameter equal to and/or somewhat greater than the width of lock collar chassis 19. Where the diameter of lock collar stop 18 is greater than the width of lock collar chassis 19, lock collar stop 18 forms a shoulder, thus limiting the forward travel of lock collar 22 along lock collar chassis 19.

The interior portions of head 17 are formed by two interconnected, asymmetrical cylindrical cavities at right angles to one another. The smaller posterior cavity is formed to correspond to the anterior end of body 20. The larger cavity is formed to enclose drive collar 11, first miter gear 13, second miter gear 15 and centering stud 14. In proximity to the upper rim of the larger cavity is formed an annular groove corresponding to inside snap ring 12. A portion of the upper posterior side of the larger cavity is removed, to form a flattened segment, to allow for proper installation and function of inside snap ring 12. A centering hole is formed on the bottom, interior face of the larger cavity corresponding to centering stud 14.

Handle 25 is cylindrical, with rounded sides and asymmetrical circular openings at each end, with hollowed interior portions. The hollowed interior portions of handle 25 vary in diameter to form shoulders to support hub 27 and ring gear 33. The largest cavity corresponding to ring gear 33 also has two or more semi-circular grooves formed into its walls corresponding to anti-rotation pins 34. The grooves are formed in straight lines parallel to the longitudinal axis of handle 25. The grooves are formed to a depth of one-half the diameter of anti-rotation pins 34. The ring gear cavity also has an annular groove formed into its walls corresponding to spiral snap ring 36.

As drawn, handle key 24 is hexagon-shaped, identical in size and shape to lock collar chassis 19, and is an integral part of handle 25. Handle key 24 has a circular opening at its anterior end forming a cavity that interconnects with the hollowed interior portions of handle 25.

Figure 9:
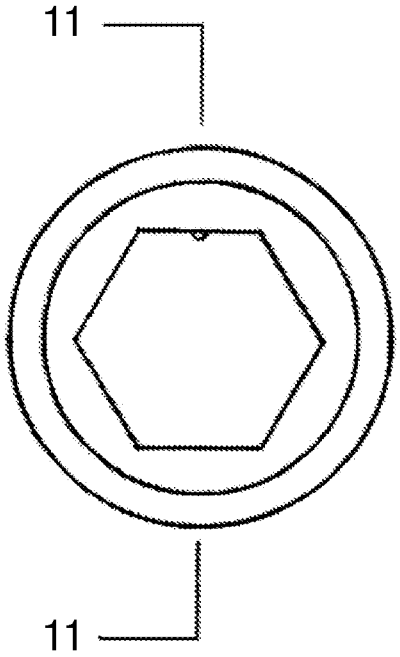
FIG. 9 is a posterior end view of lock collar 22 with 6-point lock cavity.
Figure 10:
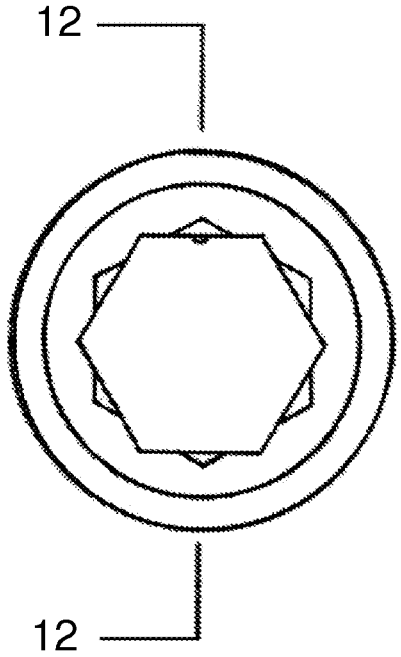
FIG. 10 is a posterior end view of lock collar 22 with 12-point lock cavity.
Figure 11:
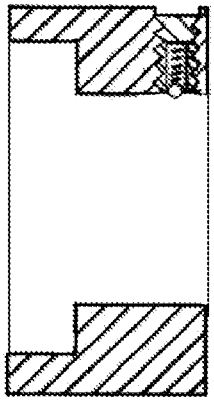
FIG. 11 is a sectional view of lock collar 22 per section line 11-11 of FIG. 9.
Figure 12:
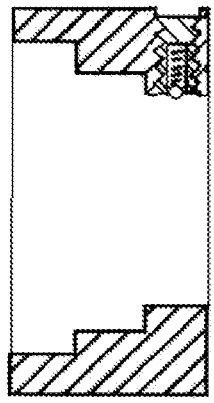
FIG. 12 is a sectional view of lock collar 22 per section line 12-12 of FIG. 10.
Figure 13:
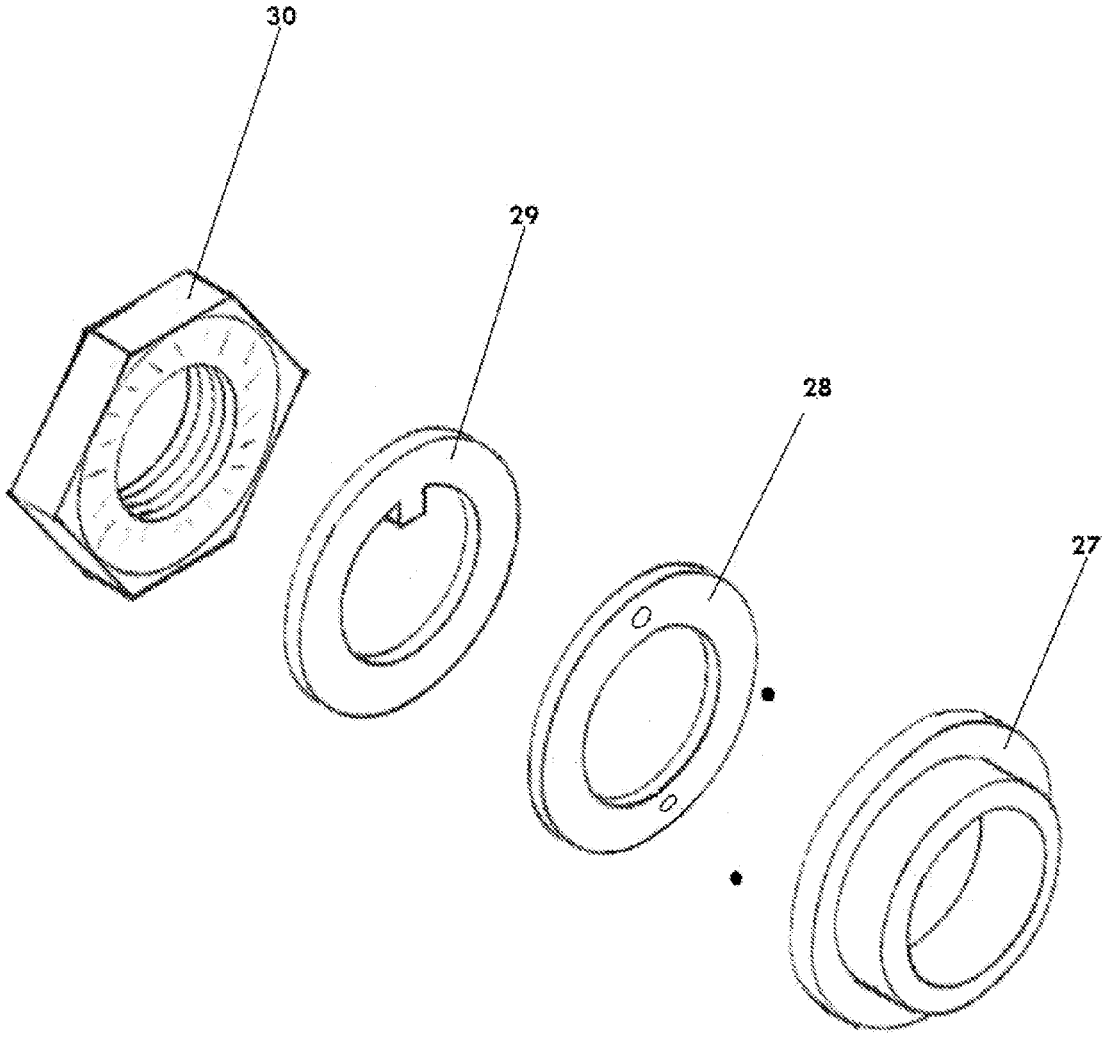
FIG. 13 is an exploded view of hub-retainer assembly and its parts.

Lock collar 22 is cylindrical, with rounded sides and asymmetrical openings at each end, with hollowed interior portions. The posterior end has a circular opening forming a cylindrical interior cavity. The anterior end has a hexagon-shaped opening forming a hexagonal interior cavity that interconnects with the posterior end cylindrical cavity. The shape and size of the hexagonal cavity directly corresponds to the shape and size of the exterior portions of lock collar chassis 19. Ball detent assembly 21 is installed to correspond to detents on lock collar chassis 19. Lock collar 22 provides a means to, when desired, rigidly connect handle 25 to body 20 to prevent handle 25 from rotating around the longitudinal axis of body 20. In another preferred embodiment (FIG. 10, 12), lock collar 22 would have a third, double-hexagon-shaped, interior cavity formed to correspond to handle key 24. The cavity, being similar to the interior portions of a common twelve-point socket, allows for twelve possible handle-locking positions rather than six possible handle locking positions of the previous embodiment (FIGS. 9, 11).

Thrust washer 23 is a standard friction reducing, flat type washer commonly known and is installed to prevent deterioration of parts through normal use.

Hub 27 is cylindrical, with rounded sides, an annular, posterior flange and symmetrical circular openings at each end to form hollowed, circular interior portions. Hub 27 provides a means to transfer loads from handle 25 to body 20 and, through bearing washer 28 and tab washer 29, to lock nut 30. In another preferred embodiment, the hollowed, circular interior portions are enlarged to accept a corresponding bearing assembly insert. The bearing assembly insert is installed to reduce unnecessary friction and part deterioration.

Bearing washer 28 is similar to a standard flat type washer. It has a center hole with at least two additional, smaller holes formed through its flange. The smaller holes are formed symmetrically spaced around the circumference of the center hole. The diameter of the smaller holes through the flange is somewhat greater than the thickness of bearing washer 28. A single ball bearing, also with a diameter greater than the thickness of bearing washer 28 and corresponding to that of the smaller hole, is installed into each of the smaller holes. When hub 27 rotates, the ball bearings are rolled between hub 27 and inside tab washer 29 and rotate bearing washer 28 as necessary, keeping equal spacing between the ball bearings. Bearing washer 28 allows hub 27 and handle 25 to rotate around body 20 while inside tab washer 29 and most importantly lock nut 30 remain stationary relative to body 20.

Inside tab washer 29 is a standard internal key type flat washer as is commonly known.

Lock nut 30 is a standard rotation-resistant type threaded fastener as is commonly known.

Drive shaft 31 is an elongated rod, with rounded sides and fixtures formed at each end. The anterior end of drive shaft 31 forms a spindle corresponding to the hub of second miter gear 15 and with a threaded circular cavity corresponding to second miter gear retainer 16. At the posterior end, drive shaft 31 forms a square drive receiver corresponding to the drive stem portion of ratchet mechanism 35.

Ring gear 33 is cylindrical, with rounded sides and symmetrical openings at each end, and with hollowed, circular interior portions. As is common of inside type ring gears found in many socket wrenches, the interior portions of ring gear 33 have a certain number of teeth of a particular size and shape. The size, shape and number of teeth of ring gear 33 correspond to the particular chosen ratchet mechanism. The exterior portions of ring gear 33 have two or more semi-circular grooves formed into its sides corresponding to anti-rotation pins 34. The grooves are formed in straight lines parallel to the longitudinal axis of ring gear 33 and are formed to a depth of one-half the diameter of anti-rotation pins 34. The posterior opening has an annular recess corresponding to posterior flange portion of ratchet mechanism 35.

Ratchet mechanism 35 is a standard, bi-directional torque transfer type of assembly as is found in many socket wrenches.

Drive collar 11 is circular, with rounded sides, a flat bottom end, and a socket drive stem formed at the top end. The circular portion has two round segments, top and bottom, with the bottom segment having a somewhat smaller diameter and an annular groove corresponding to inside snap ring 12. The bottom end of drive collar 11 has a hexagon-shaped interior cavity corresponding to the hub of first miter gear 13. The cavity has a threaded hole centered within it corresponding to centering stud 14.

First miter gear 13 is a standard beveled type cog as is commonly known. The exterior portions include a hexagon-shaped hub, with six flat sides and a hollow interior, formed to correspond to the interior portions of the hexagon-shaped cavity in the bottom end of drive collar 11. The shape of the hub prevents rotation of first miter gear 13 relative to drive collar 11.

Second miter gear 15 is a standard beveled type cog as is commonly known. The exterior portions include a circular hub, with rounded sides and a hollow interior, corresponding to the spindle of drive shaft 31.

Centering stud 14 is a solid hexagonal rod, with six flat sides and fixtures formed at each end. The top end has a rounded, threaded portion and the bottom end has a semi-circular portion corresponding to the centering hole on the bottom, interior face of head 17.

Ball detent assembly 21 is a standard spring loaded ball assembly as is commonly known and is used in conjunction with detents on lock collar chassis 19 to retain lock collar 22 in desired locked or unlocked position.

In another preferred embodiment (not drawn), body 20 and drive shaft 31 are articulated in proximity to head 17, permitting head 17 a limited degree of movement, up or down, off the longitudinal axis of body 20. This form of articulation is common to a certain type of socket wrench and is sometimes referred to as a flexible head or swivel head socket wrench.

In another preferred embodiment (not drawn), the longitudinal axis of handle 25 is not aligned with head 17 in the previous manner, but is offset a certain amount forming a curved portion of body 20. Drive shaft 31 could be formed using an assembly of tightly wound wire strands (i.e. wire rope) or by using a chain-link type of assembly. This form of misaligning the handle is common to a certain type of socket wrench and is sometimes referred to as offset-handle socket wrenches.

In another preferred embodiment (not drawn), first miter gear 13 has a greater number of teeth than second miter gear 15, giving handle 25 a gear ratio of greater than 1:1 over the drive collar assembly. When handle 25 is rotated to effect rotation of the work piece, this increased ratio allows greater torque output than possible in the previous embodiment. This form of gear reduction is sometimes referred to as a torque multiplier.

To assemble, the anterior end of body 20 is permanently attached in a fixed position to head 17. This step is not necessary when head 17 and body 20 are integral (FIG. 5, 6). Lock collar 22 is mounted over the posterior end of body 20 and is installed onto lock collar chassis 19 with ball detent assembly 21 aligned with the detents on lock collar chassis 19. Thrust washer 23 is mounted over the posterior end of body 20 and installed against lock collar chassis 19. Handle 25 is mounted over the posterior end of body 20 and installed against thrust washer 23. Hub 27 is mounted through the posterior opening of handle 25, over the posterior end of body 20 and installed against the shoulder formed on the interior of handle 25. Bearing washer 28 is mounted, with ball bearings in place, through the posterior opening of handle 25, over the posterior end of body 20, and installed against hub 27. Inside tab washer 29, with tab aligned to keyway, is mounted, through the posterior opening of handle 25, over the posterior end of body 20, and installed against bearing washer 28. Lock nut 30 is mounted through the posterior opening of handle 25, and installed onto threaded portion of body 20, and is tightened as necessary. Drive shaft 31 is installed through the posterior opening of handle 25 and into the posterior opening of body 20, and is positioned so that the anterior end spindle extends into head 17. Second miter gear 15 is installed through the larger cavity of head 17, mated to the spindle on the anterior end of drive shaft 31 and retainer screw 16 is installed. Ratchet mechanism 35 is installed into ring gear 33 and retained with snap ring 32 to form a ratchet assembly. The ratchet assembly is installed into posterior opening of handle 25 and ratchet mechanism 35 drive stem is mated to the receiver of drive shaft 31. With the semi-circular grooves of ring gear 33 aligned with the semi-circular grooves of handle 25, anti-rotation pins 34 are installed into the cavities formed at the grooves. Spiral snap ring 36 is installed into annular groove within posterior opening of handle 25. First miter gear 13 hub is installed into the cavity at the bottom end of drive collar 11 and centering stud 14 is installed to form a drive collar assembly. Inside snap ring 12 is installed into annular groove in drive collar 11 and drive collar assembly is rotatably installed into the larger cavity of head 17 and retained by inside snap ring 12.

Figure 7:
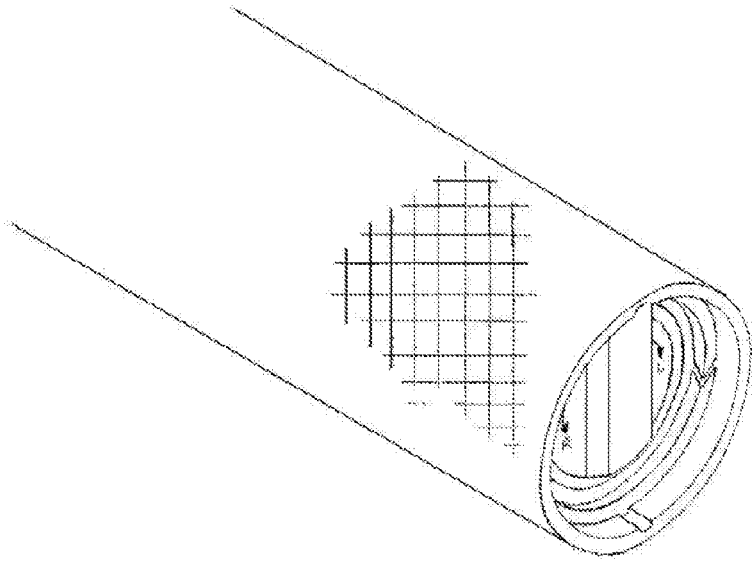
FIG. 7 is a section of the anterior portion of handle 25 per section line 7-7 of FIG. 5 with ratchet assembly 35 installed.
Figure 8:
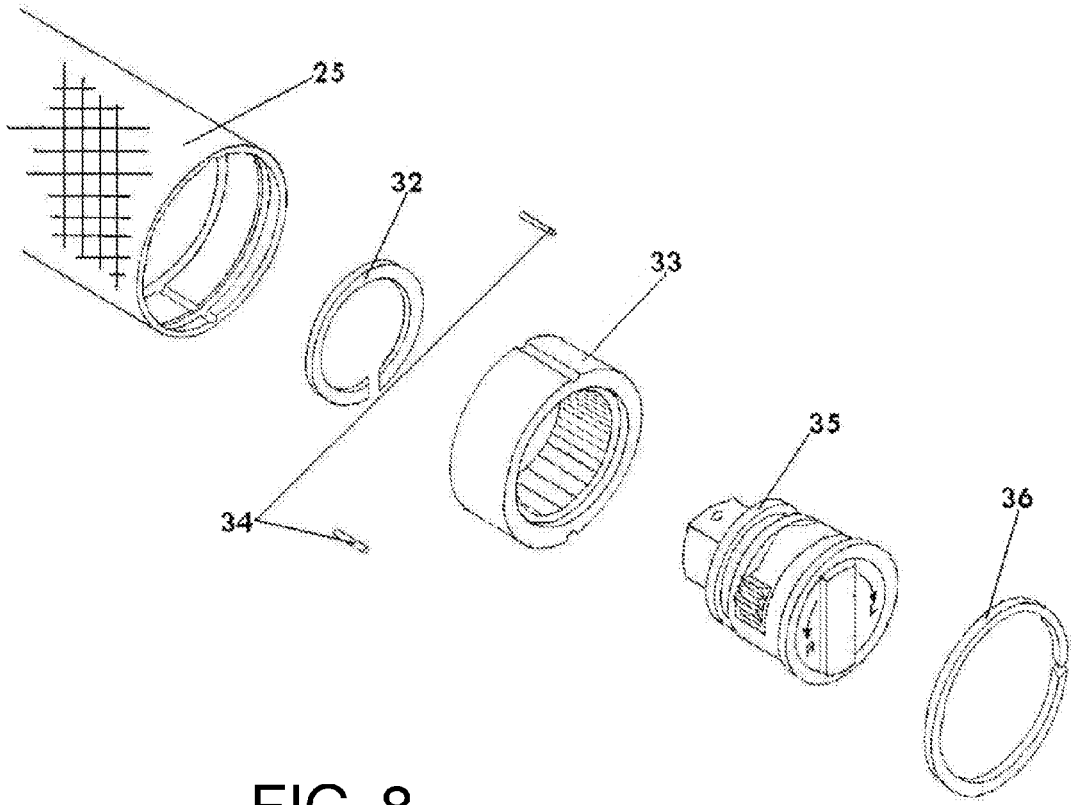
FIG. 8 is a section of the anterior portion of handle 25 per section line 7-7 of FIG. 5 with exploded view of ratchet assembly 35.

To operate socket wrench 10, choose either right-hand (clockwise) or left-hand (counter-clockwise) work-piece rotation using the ratchet mechanism 35 selector switch at the posterior end of handle 25 (FIG. 7). Next, chose handle 25 either locked, unable to rotate around the longitudinal axis of body 20, or unlocked with handle 25 able to rotate relative to body 20. Locking handle 25 allows higher torque input by mechanically opposing rotation of handle 25. To lock handle 25, lock collar 22 is moved toward the posterior detent while rotating handle 25 to align handle key 24 with lock collar 22 and lock collar chassis 19. When alignment is achieved, lock collar 22 engages handle key 24 while still engaged to lock collar chassis 19, locking handle 25 in position relative to body 20 and ball detent assembly 21 engages posterior detent.

With the selector switch in the right-hand rotation position and handle 25 locked, socket wrench 10 functions in the same manner as many common socket wrenches. By rotating socket wrench 10 in a right-hand direction around the rotational axis of the work-piece, in the common manner, torque is conveyed from body 20 and lock collar 22 through handle 25 to ring gear 33. Ring gear 33 is engaged by ratchet mechanism 35 pawls and torque is conveyed through ratchet mechanism 35 to drive shaft 31. Drive shaft 31 conveys this torque through second miter gear 15 to first miter gear 13. First miter gear 13, being mounted in a fixed position to drive collar 11, conveys this torque through the drive collar assembly to the work-piece, thus causing the work-piece to rotate in the right-hand direction. No parts rotate relative to body 20, head 17 and handle 25.

Rotating socket wrench 10 in the opposite direction, in the common manner, the pawl of ratchet mechanism 35, as intended, is disengaged from ring gear 33. This permits ratchet mechanism 35, drive shaft 31, second miter gear 15, drive collar assembly and work-piece to rotate relative to body 20, head 17 and handle 25 and socket wrench 10 can be repositioned without rotating the work-piece. Change the ratchet mechanism 35 selector switch to the left-hand setting and socket wench 10 functions in the same manner by rotating work-piece and being repositioned in the opposite direction of right-hand setting.

To unlock handle 25, lock collar 22 is moved forward to disengage handle key 24 and posterior detent and to engage anterior detent. Handle 25 unlocked, socket wrench 10 is nonetheless functional than previously described except that handle 25 rotation is opposed manually by user rather than mechanically by lock collar 22.

A work piece can also be rotated using only handle 25. With handle 25 unlocked and ratchet mechanism 35 selector switch set for right-hand rotation, applying rotational force in the right-hand direction to handle 25 causes handle 25 and ring gear 33 to rotate. Ring gear 33 engages ratchet mechanism 35 pawl and conveys this torque through ratchet mechanism 35 to drive shaft 31. Drive shaft 31 conveys this torque through second miter gear 15 to first miter gear 13. First miter gear 13, being mounted in a fixed position to drive collar 11, conveys this torque through the drive collar 11 to the work-piece, thus causing the work-piece to rotate in the right-hand direction. Applying rotational force to handle 25 in the opposite direction, torque is transferred from handle 25 to ring gear 33. The pawls of ratchet mechanism 35, as intended, disengage ring gear 33 to permit handle 25 to be repositioned without rotating the work-piece.

Finally, the previously described manners of operation may be employed simultaneously where socket wrench 10 and handle 25 are both rotated at the same time to effect work-piece rotation. This function also allows simultaneous repositioning of both socket wrench 10 and handle 25. Using socket wrench 10 in this manner greatly increases the efficiency of the tool and provides a more ergonomic motion for the user.

What is claimed is:

1. A wrench type ratchet handle comprising:

an elongated body having an anterior end and a posterior end, a receiving tunnel between said anterior end and said posterior end and a body fixture means including a lock collar stop and a lock collar chassis such that said lock collar stop and said lock collar chassis are permanently attached in a fixed position;

a head permanently attached in a fixed position to said body anterior end having a working section including a drive collar, including a socket retention means, rotatively mounted in working relationship to said head and including a set of miter gears such that said drive collar and said miter gears are operationally coupled;

a rigid drive shaft in working relationship to said body receiving tunnel having a posterior end including a receiving area and having an anterior end including a spindle in working relationship to said miter gear set;

a hollowed handle having an anterior end including a handle fixture means permanently attached in a fixed position to said handle including a handle key and said handle having a posterior end including a first interior receiving area and a second interior receiving area;

a hub-retainer assembly means including a hub in working relationship to said handle first interior receiving area and to said body, a bearing washer including a perforated washer and a set of bearings in working relationship to said hub and said body, an inside tab washer in working relationship to said bearing washer and said body and a lock nut in working relationship to said inside tab washer and said body such that said bearing washer and said inside tab washer isolate rotary motion of said handle and said hub from said lock nut and said body;

a ratchet mechanism assembly means including a ring gear in working relationship to said handle second interior receiving area and a set of anti-rotation pins in working relationship to said handle and said ring gear prohibiting said ring gear rotation relative to said handle, and a bi-directional ratchet mechanism in working relationship to said ring gear and said drive shaft posterior end receiving area;

an axially movable locking means including a lock collar in working relationship to said lock collar chassis such that said lock collar axial movement is permitted along said lock collar chassis axis and rotary motion of said lock collar about said lock collar chassis axis is prohibited and such that engagement of said lock collar with both said lock collar chassis and said handle key prohibits rotary motion of said handle and such that engagement of said lock collar with only said lock collar chassis permits rotary motion of said handle.

2. The wrench type ratchet handle of claim 1 further comprising an offset handle means including a curved body and an offset handle such that rotary axis of said offset handle is skewed or offset in relation to working axes of said head and further comprising a flexible drive shaft means including a non-rigid drive shaft such that said non-rigid drive shaft is in working relationship to said curved body.

3. The wrench type ratchet handle of claim 1 further comprising an articulated head means including a pivoting union connecting said articulated head to said body such that said articulated head is able to pivot out of axial alignment to said body and further comprising an articulated drive shaft means including a swivel able union such that said articulated drive shaft is in working relationship to said articulated head and to said body.

4. The wrench type ratchet handle of claim 1 further comprising a torque multiplier means including a bevel gear set of asymmetric gears having a ratio greater than 1:1 such that rotary torque input through said handle achieving a mechanical advantage and increased torque output through said drive collar.

5. The wrench type ratchet handle of claims 1, 2, 3 or 4 wherein a hub-retainer assembly means is provided such that said hub-retainer assembly isolates rotary motion of said handle relative to said body from a threaded fastener handle retention means and to retain said handle in working relationship to said body and wherein said hub-retainer assembly includes a bearing assembly in working relationship to said handle, to said body and to said threaded fastener handle retention means and said threaded fastener handle retention means in working relationship to said body and to said bearing assembly.

6. The wrench type ratchet handle of claims 1, 2, 3 or 4 wherein an axially movable locking means is provided such that when said axially movable locking means is in a locked position, rotary motion of said handle relative to said body is prohibited and wherein said axially moveable lock means includes a handle fixture permanently attached in a fixed position to said handle, a body fixture permanently attached in a fixed position to said body and said axially movable lock in working relationship to said body fixture and wherein when said axially movable locking means is in engagement with said handle fixture and said body fixture in said locked position, said engagement prohibits rotary motion of said handle relative to said body.

* * * * *